US006976614B1

(12) United States Patent
Caramanis

(10) Patent No.: US 6,976,614 B1
(45) Date of Patent: Dec. 20, 2005

(54) COAT RETAINING METHOD AND APPARATUS

(76) Inventor: Lisa Caramanis, 143 Partridge Dr., Middleton, NH (US) 03887

( * ) Notice: Subject to any disclaimer, the term of this patent is extended or adjusted under 35 U.S.C. 154(b) by 192 days.

(21) Appl. No.: 10/439,633

(22) Filed: May 16, 2003

Related U.S. Application Data

(60) Provisional application No. 60/381,272, filed on May 16, 2002.

(51) Int. Cl.[7] ..... A45F 5/00

(52) U.S. Cl. ..... 224/255; 224/160; 224/184; 224/259; 224/269; 224/927

(58) Field of Search ..... 224/153, 159, 224/160, 184, 247, 255, 257, 259, 269, 674, 224/675, 927; 2/94

(56) References Cited

U.S. PATENT DOCUMENTS

| | | | | | |
|---|---|---|---|---|---|
| 1,403,431 | A | * | 1/1922 | McElhone | 224/255 |
| 1,959,331 | A | * | 5/1934 | Bour | 2/94 |
| 2,169,080 | A | * | 8/1939 | Clark | 224/247 |
| 2,441,115 | A | * | 5/1948 | Walter | 224/259 |
| 2,653,038 | A | * | 9/1953 | Dyer | 224/675 |
| 2,754,532 | A | * | 7/1956 | Kanehl et al. | 224/255 |
| 3,077,292 | A | * | 2/1963 | Gehrke | 224/184 |
| 3,682,358 | A | * | 8/1972 | Richey | 224/250 |
| 3,893,604 | A | * | 7/1975 | Skinner | 224/257 |
| 4,125,211 | A | * | 11/1978 | Handsman | 224/255 |
| 5,215,239 | A | * | 6/1993 | Walters, Jr. | 224/259 |
| 5,259,539 | A | * | 11/1993 | Brotman | 224/153 |
| 5,873,503 | A | * | 2/1999 | Atherton et al. | 224/259 |
| 6,056,173 | A | * | 5/2000 | Gillespie | 224/247 |

* cited by examiner

*Primary Examiner*—Gary E. Elkins
(74) *Attorney, Agent, or Firm*—O'Connell Law Firm

(57) ABSTRACT

An apparatus and method for retaining an article of clothing, such as a jacket or coat, relative to a wearer. The apparatus can have a central portion, a first shoulder loop with first and second ends coupled to the central portion, a second shoulder loop with first and second ends coupled to the central portion, and a mechanism, such as a pair of jaws or a coupling flap, for retaining and supporting an article of clothing relative to the central portion. The method can have the wearer dispose his or her arms through the shoulder loops and retain an article of clothing using the retaining and supporting mechanism.

5 Claims, 3 Drawing Sheets

COAT RETAINING METHOD AND APPARATUS

FIELD

The present invention relates generally to retaining mechanisms. Stated more particularly, disclosed and protected by the present patent are an apparatus and method for allowing a convenient carrying of a user's coat or similar article.

BACKGROUND

One knowledgeable in the art will be well aware that the prior art has disclosed a plurality of support devices, including devices for retaining a user's jacket or coat. Nonetheless, as with substantially all fields of endeavor, there remains room for further advancement, such as in the solving of problems that prior art inventors have been unable to master and problems that others have simply failed to recognize. As a result, there is a need for a mechanism for carrying a user's coat or similar article for use by travelers, walkers, and other persons that is capable of providing additional advantages and functions for which prior art inventors may have not yet appreciated a need and that is capable of resolving issues that prior art inventors have been able to solve.

SUMMARY

Certain objects and advantages of the invention will become obvious not only to one who reviews the present specification and drawings but also to one who has an opportunity to make use of an embodiment of the present invention for a coat retaining method and apparatus. However, it will be appreciated that, although the accomplishment of each of the foregoing objects in a single embodiment of the invention may be possible and indeed preferred, not all embodiments will seek or need to accomplish each and every potential object and advantage. Nonetheless, all such embodiments should be considered within the scope of the present invention.

One basic embodiment of the present invention takes the form of an apparatus for retaining an article of clothing relative to a wearer that comprises a central portion, first and second shoulder loops each with first and second ends coupled to the central portion, and a means for retaining and supporting an article of clothing relative to the central portion. Under even this most basic arrangement an article of clothing can be comfortably yet securely retained and supported by the retaining apparatus without requiring use of a wearer's hands or arms.

The means for retaining and supporting an article of clothing can comprise a pair of retaining jaws that can be coupled to the central portion. In such a case, a connector member can be interposed therebetween. Alternatively, the means for retaining and supporting an article of clothing can take the form of a coupling flap with a proximal end and a distal end. The proximal end of the coupling flap can be fixed to the central portion and there can be a means for selectively retaining the distal end of the coupling flap. The means for selectively retaining the distal end of the coupling flap can be a means, such as a snap button combination, hook and loop material, or any other appropriate means, for selectively retaining the distal end of the coupling flap relative to the central portion to form a loop. With this, the coupling flap can be employed to retain an article of clothing by being passed through an aperture in the article of clothing and then by being formed into a loop. That aperture can comprise a loop, an opening, or any other suitable aperture. The retaining apparatus could further include means, such as slide buckle arrangements, for adjusting the size of each of the first and second shoulder loops to accommodate wearers of different sizes.

In an alternative expression of the invention, the retaining apparatus can comprise a first elongate member for overlying a first shoulder of a wearer wherein the first elongate member has a first end and a second end, a second elongate member for overlying a second shoulder of a wearer wherein the second elongate member has a first end and a second end, a means for retaining the first elongate member overlying a first shoulder of a wearer, a means for retaining the second elongate member overlying the second shoulder of the wearer, a means for coupling the first ends of the first and second elongate members, and a means for retaining and supporting an article of clothing relative to the first ends of the first and second elongate members. In such a case, the means for retaining the first and second elongate members overlying the first and second shoulders of the wearer can comprise means for securing the second ends of the first and second elongate members, such as to the pants of the wearer.

One will appreciate that the foregoing discussion broadly outlines certain more important goals and features of the invention to enable a better understanding of the detailed description that follows and to instill a better appreciation of the inventor's contribution to the art. Before an embodiment of the invention is explained in detail, it must be made clear that the following details of construction, descriptions of geometry, and illustrations of inventive concepts are mere examples of the many possible manifestations of the invention.

DETAILED DESCRIPTION

Advantageously, the present invention sets out with the broadly stated object of meeting the needs left by the prior art while providing a number of heretofore unrealized advantages thereover. As is the case with many inventions, the present invention for a coat retaining method and apparatus is subject to a wide variety of embodiments. However, to ensure that one skilled in the art will fully understand and, in appropriate cases, be able to practice the present invention, certain preferred embodiments of the broader invention revealed herein are described below and shown in the accompanying drawing figures. However, before any particular embodiment of the invention is explained in detail, it must be made clear that the following details of construction, descriptions of geometry, and illustrations of inventive concepts are mere examples of the many possible manifestations of the invention.

Figure 1:
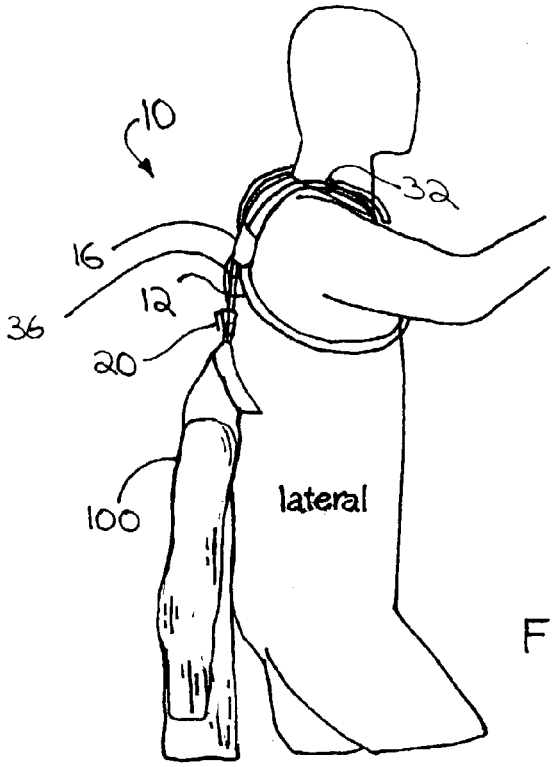
FIG. 1 is a view in side elevation of an embodiment of the present invention for a coat retaining apparatus shown as it might be worn in use.
Figure 2:
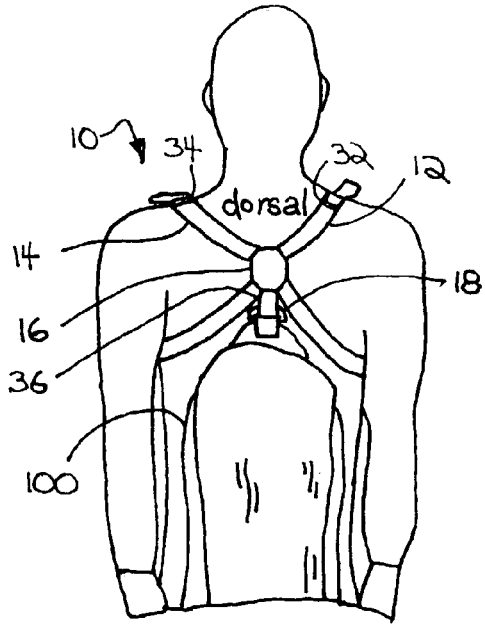
FIG. 2 is a view in rear elevation of the coat retaining apparatus, again during use.

Looking more particularly to the drawings, embodiments of the present invention for a coat retaining apparatus, which is indicated generally at 10 in each case, is shown in FIGS. 1–4 as it might be worn during use. In FIGS. 1 and 2, the coat retaining apparatus 10 can be seen to have first and second shoulder loops 12 and 14, each with first and second ends coupled or couplable to a central portion 16. Retaining jaws 20 are coupled to the central portion 16 by any appropriate mechanism, such as a D-ring 18 or the like. A connector member 36 can be interposed between the central portion 16 and the retaining jaws 20. The size of each of the first and second shoulder loops 12 and 14 can be made adjustable by appropriate means or mechanisms 32 and 34, such as slide buckle arrangements as one skilled in the art will appreciate after reading this disclosure.

Under this arrangement, the coat retaining apparatus 10 can be worn as shown with the wearer's arms and shoulders extending through the first and second shoulder loops 12 and 14 and the central portion 16 disposed against the wearer's back. A coat, jacket, or other article 100 can be retained by clamping the retaining jaws 20 about, for example, the collar, neck, or any other portion of the jacket 100. With this, a wearer can comfortably and securely retain his or her jacket 100 or the like without the necessity for using his or her hands, arms, or the like to do so. Advantageously, if the wearer so desires, the retaining jaws 20 can be left clamped to the jacket 100 even while the jacket 100 is being worn. Where a connector member 36 is incorporated into the coat retaining apparatus 10, the connector 36 can flip upwardly when the jacket 100 is so worn. With this, there is no need for de-coupling and re-coupling the jacket 100 repeatedly, and the wearer can simply slide the jacket 100 off of his or her shoulders knowing that the coat retaining apparatus 10 will provide ready support.

Figure 3:
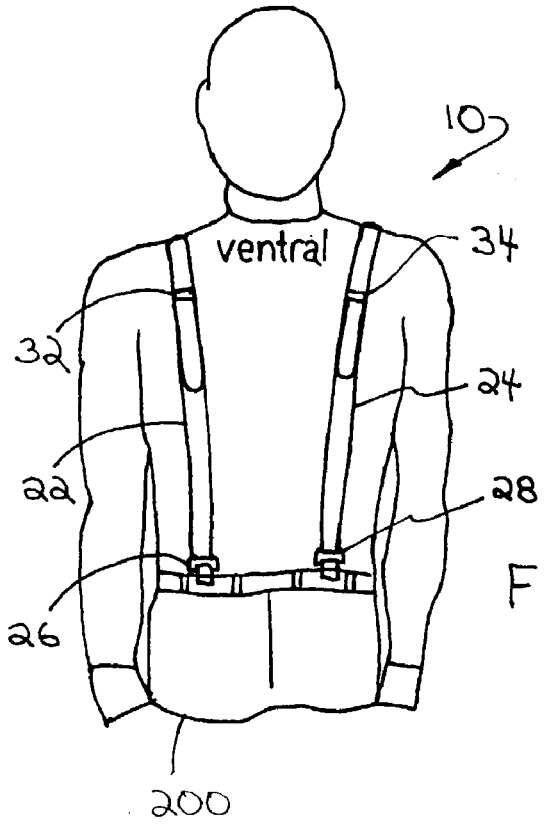
FIG. 3 is a view in front elevation of an alternative embodiment of the coat retaining apparatus, again during use.
Figure 4:
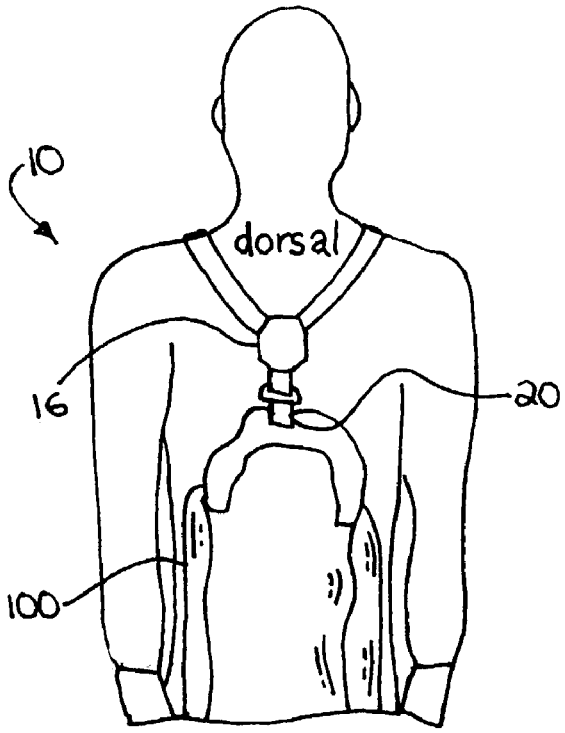
FIG. 4 is a view in rear elevation of the embodiment of the coat retaining apparatus of FIG. 3, again during use.

In FIGS. 3 and 4, the coat retaining apparatus 10 is shown in a slightly different configuration. There, first and second straps 22 and 24 are coupled to the wearer's pants 200, such as by retaining jaws 26 and 28, and then overlie the wearer's shoulders to couple with the central portion 16. The retaining jaws 20 again extend from the central portion 16 for retaining a jacket 100 or the like. A connector member 36 can again be included.

Figure 5:
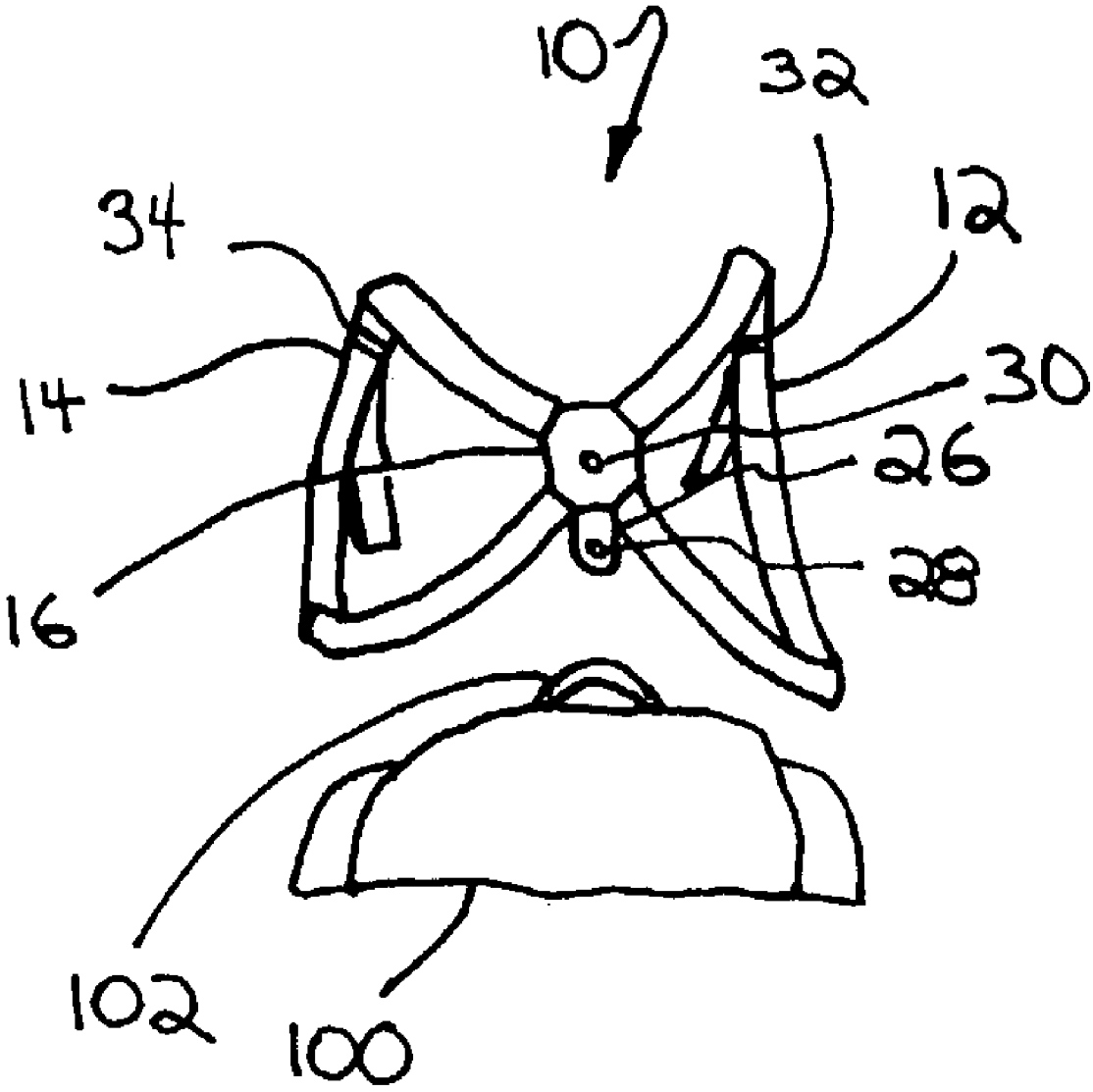
FIG. 5 is a perspective view of another alternative embodiment of the coat retaining apparatus according to the present invention.

In FIG. 5, an alternative embodiment of the coat retaining apparatus is again indicated generally at 10. There, one sees that the coat retaining apparatus 10 again has first and second shoulder loops 12 and 14. In this case, the first and second ends of the shoulder loops 12 and 14 are fixed directly to the central portion 16 as by stitching or the like. Again, the size of the first and second shoulder loops 12 and 14 can be adjusted by appropriate means or mechanisms 32 and 34 respectively.

In this embodiment, however, the retaining jaws 20 are replaced by a coupling flap 26 with a proximal end fixed to the central portion 16 and a distal end that can be selectively coupled to the central portion 16 by a coupling means or mechanism, such as first and second snap button components 28 and 30, a button and aperture combination, hook and loop material, or any other appropriate arrangement. With this, a jacket or other article 100 with a loop 102 thereon can be retained by the coat retaining apparatus 10 by a user's passing the coupling flap 26 through the loop 102 and then coupling the distal end of the coupling flap 26 to the central portion 16 by use of the coupling means thereby to form the coupling flap 26 into a loop. Where a given jacket or other article 100 does not include a loop 102, the coat retaining apparatus 10 can further include a strip of material that can be suitably fastened to the jacket or other article 100 to form the loop 102.

It should be appreciated that the elements that together form the coat retaining apparatus 10 could be crafted from a wide variety of materials. By way of example, however, the first and second shoulder loops 12 and 14 and the central portion 16 can be formed from a fabric, an elastic material, leather, or substantially any other material. Particularly where adjustment means 32 and 34 are not included, the first and second shoulder loops 12 and 14 can incorporate an elastic material so that the coat retaining apparatus 10 can be worn comfortably by wearer's of different body types and sizes. The central portion 16 also could be constructed from an elastic material but preferably will have at least a portion that is somewhat inelastic to provide solid support for the first and second shoulder straps 12 and 14 and for the retaining jaws 20 or the coupling flap 26, particularly when a jacket 100 or other article is to be supported. Where provided, the retaining jaws 20 and the D-ring 18 could also be crafted from a variety of materials but preferably will be crafted from rigid, durable material, such as metal, plastic, or the like.

From the foregoing, it will be clear that the present invention has been shown and described with reference to certain preferred embodiments that merely exemplify the broader invention revealed herein. Certainly, those skilled in the art can conceive of alternative embodiments. For instance, those with the major features of the invention in mind could craft embodiments that incorporate those major features while not incorporating all of the features included in the preferred embodiments.

With this in mind, the claims that follow are intended to define the scope of protection to be afforded the inventor, and those claims shall be deemed to cover equivalent constructions insofar as they do not depart from the spirit and scope of the present invention. A plurality of those claims may express certain elements as a means for performing a specific function, at times without the recital of structure or material. As the law demands, any such claims shall be construed to cover not only the corresponding structure and material expressly described in the specification but also equivalents thereof.

I claim as deserving the protection of Letters Patent:

1. A method for retaining an article of clothing relative to a wearer comprising the steps of:

providing a retaining apparatus comprising a first elongate member for overlying a first shoulder of a wearer wherein the first elongate member has a first end and a second end; a second elongate member for overlying a second shoulder of a wearer wherein the second elongate member has a first end and a second end; a means for retaining the first elongate member overlying a first shoulder of a wearer; a means for retaining the second elongate member overlying the second shoulder of the wearer; a means for coupling the first ends of the first and second elongate members at a central portion; and a means for retaining and supporting an article of clothing relative to the first ends of the first and second elongate members;

providing an article of clothing disposing the first and second elongate members overlying the first and second shoulders of the wearer;

causing the article of clothing to be retained by the retaining apparatus by use of the means for retaining and supporting an article of clothing relative to the first ends of the first and second elongate members;

whereby the article of clothing can be comfortably yet securely retained and supported by the retaining apparatus without requiring use of a wearer's hands or arms.

2. The method of claim 1 wherein the step of providing a retaining apparatus further comprises forming the first and second elongate members into loops and wherein the step of disposing the first and second members overlying the first and second shoulders of the wearer comprises disposing the shoulders of the wearer through the loops.

3. The method of claim 1 wherein the step of providing a retaining apparatus comprises providing a retaining apparatus wherein the means for retaining and supporting an article of clothing comprises a pair of retaining jaws and wherein the step of causing an article of clothing to be retained by the retaining apparatus comprises engaging the retaining jaws relative to the article of clothing.

4. The method of claim 1 wherein the step of providing a retaining apparatus comprises providing a retaining apparatus wherein the means for retaining and supporting an article of clothing comprises a coupling flap with a proximal end and a distal end wherein the proximal end of the coupling flap is fixed to the central portion and further comprising a means for selectively retaining the distal end of the coupling flap, wherein the step of providing an article of clothing comprises providing an article of clothing with an aperture associated therewith, and wherein the step of causing an article of clothing to be retained by the retaining apparatus comprises passing the coupling flap through the aperture and then retaining the distal end of the coupling flap by the means for selectively retaining the distal end of the coupling flap.

5. The method of claim 1 wherein the step of providing an article of clothing comprises providing a coat and wherein the step of causing the article of clothing to be retained by the retaining apparatus by use of the means for retaining and supporting an article of clothing relative to the first ends of the first and second elongate members includes wearing the coat while the coat is retained by the means for retaining and supporting an article of clothing.

* * * * *